US010960693B2

(12) United States Patent
Arakawa

(10) Patent No.: US 10,960,693 B2
(45) Date of Patent: Mar. 30, 2021

(54) IMAGE FORMING SYSTEM

(71) Applicant: BROTHER KOGYO KABUSHIKI KAISHA, Nagoya (JP)

(72) Inventor: Yuta Arakawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 13 days.

(21) Appl. No.: 16/575,486

(22) Filed: Sep. 19, 2019

(65) Prior Publication Data

US 2020/0101776 A1 Apr. 2, 2020

(30) Foreign Application Priority Data

Sep. 28, 2018 (JP) ..... JP2018-184136

(51) Int. Cl.
*B41J 25/00* (2006.01)
*B41J 2/045* (2006.01)

(52) U.S. Cl.
CPC ..... *B41J 25/006* (2013.01); *B41J 2/04573* (2013.01); *B41J 2/04586* (2013.01)

(58) Field of Classification Search
CPC .... B41J 29/393; B41J 19/202; B41J 13/0009; B41J 25/006; B41J 29/38; B41J 2/045; B41J 2/04573; B41J 2/04586
See application file for complete search history.

(56) References Cited

U.S. PATENT DOCUMENTS

2004/0227781 A1* 11/2004 Kaburagi ..... B41J 2/0458 347/14
2010/0123751 A1* 5/2010 Iesaki ..... B41J 29/38 347/16

FOREIGN PATENT DOCUMENTS

| | | | |
|---|---|---|---|
| JP | 2001-001592 | A | 1/2001 |
| JP | 2001-232882 | A | 8/2001 |
| JP | 2004-202713 | A | 7/2004 |
| JP | 2008-080669 | A | 4/2008 |

* cited by examiner

*Primary Examiner* — Jannelle M Lebron
(74) *Attorney, Agent, or Firm* — Scully, Scott, Murphy & Presser, PC

(57) ABSTRACT

After an ejector passes an ejection end position, a controller controls a second conveyor to convey a sheet in a sub-scanning direction. The ejection end position is a position at which ink ejection by the ejector ends before reaching a turn position. An ejection start position is a position at which ink ejection by the ejector starts after turning at the turn position. Based on positional relationship between the ejection end position and a standard position, the controller adjusts timing of conveyance of the sheet or shift the turn position from the standard position in a direction of reducing an overlap between a sheet conveyance period after the ejector passes the ejection end position and an ejector deceleration period before the ejector reaches the turn position. The standard position is a standard turn position of the ejector and is determined from the ejection end position and the ejection start position.

14 Claims, 13 Drawing Sheets

IMAGE FORMING SYSTEM

CROSS REFERENCE TO RELATED APPLICATIONS

This application claims priority from Japanese Patent Application No. 2018-184136 filed Sep. 28, 2018. The entire content of the priority application is incorporated herein by reference.

TECHNICAL FIELD

This disclosure relates to an image forming system.

BACKGROUND

As an image forming system, an inkjet printer that forms an image on a sheet by ejecting ink is conventionally known. Normally, an inkjet printer forms an image on a sheet by reciprocating a carriage on which an inkjet head is mounted along a main scanning direction and by intermittently conveying the sheet in a sub-scanning direction. Ejection of ink is performed while conveying the carriage when the sheet is stopped.

SUMMARY

According to one aspect, this specification discloses an image forming system. The image forming system includes an ejector, a first conveyor, a second conveyor, a common power supply, and a controller. The ejector is configured to eject ink toward a sheet. The first conveyor is configured to cause the ejector to reciprocate along a main scanning direction. The second conveyor is configured to convey the sheet in a sub-scanning direction. The common power supply is configured to supply electric power to the first conveyor and the second conveyor. The controller is configured to repeatedly perform controlling the second conveyor to convey the sheet by a particular amount in the sub-scanning direction, controlling the first conveyor to convey the ejector to a turn position along the main scanning direction, and controlling the ejector in a conveyance process to eject ink toward the sheet in a stopped state, thereby forming an image on the sheet. The controller is configured to, after the ejector passes an ejection end position, control the second conveyor to convey the sheet by the particular amount in the sub-scanning direction. The ejection end position is a position of the ejector in the main scanning direction and a position at which ink ejection by the ejector ends before reaching the turn position. An ejection start position is a position of the ejector in the main scanning direction and a position at which ink ejection by the ejector starts after turning at the turn position. The controller is further configured to, based on a positional relationship between the ejection end position and a standard position, adjust timing of conveyance of the sheet or shift the turn position from the standard position in a direction of reducing an overlap between a sheet conveyance period after the ejector passes the ejection end position and an ejector deceleration period before the ejector reaches the turn position. The standard position is a standard turn position of the ejector and is determined from the ejection end position and the ejection start position.

BRIEF DESCRIPTION OF THE DRAWINGS

Embodiments in accordance with this disclosure will be described in detail with reference to the following figures wherein.

DETAILED DESCRIPTION

In order to improve throughput of printing, it is also known that, at timing when ink ejection ends during carriage conveyance on the way to the turn position, conveyance of the sheet is started without waiting for the carriage to reach the turn position.

This overlapped conveyance operation requires concurrently supplying driving currents to the carriage conveyance mechanism and the sheet conveyance mechanism. Hence, in a conventional system, a power supply having a large suppliable current that can concurrently supply driving currents is adopted as a common power supply.

However, a power supply having a large suppliable current is more expensive than a power supply having a small suppliable current. On the other hand, if a small power supply having a small suppliable current is adopted in order to reduce the manufacturing cost, overlapped conveyance operations cannot be performed in the image forming system, or a driving current to each conveyance mechanism needs to be suppressed.

In view of the foregoing, an aspect of an object of this disclosure is to provide technology that, in a case where a plurality of conveyance mechanisms is operated by power supply from a common power supply, enables image formation on a sheet by efficiently utilizing the common power supply.

Some aspects of this disclosure will be described while referring to the attached drawings.

First Embodiment

Figure 1:
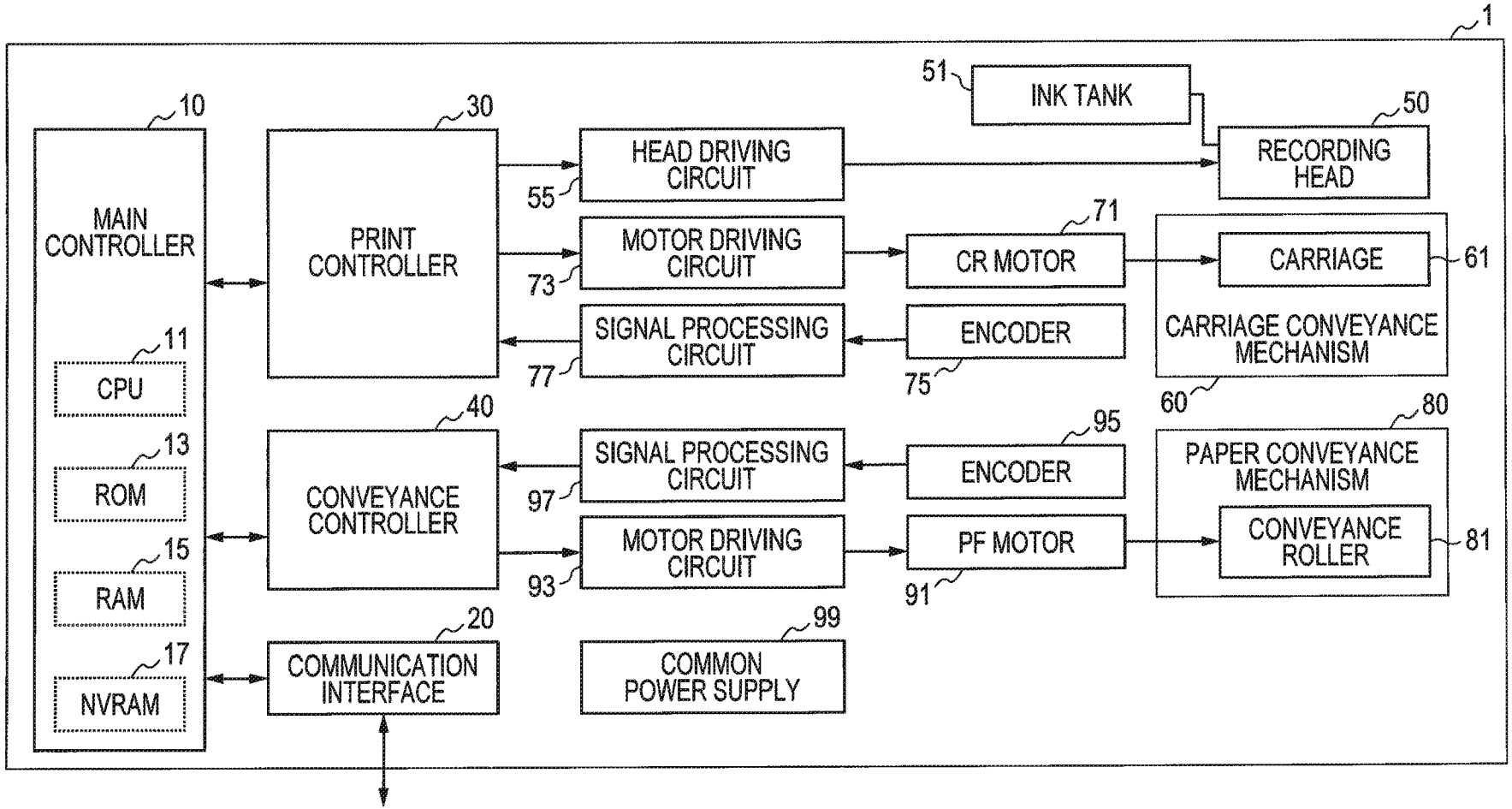
FIG. 1 is a block diagram showing the configuration of an image forming system.

An image forming system 1 of the present embodiment shown in FIG. 1 is configured as an inkjet printer. The image forming system 1 includes a main controller 10, a communication interface 20, a print controller 30, and a conveyance controller 40.

The main controller 10 includes a CPU 11, a ROM 13, a RAM 15, and an NVRAM 17. The ROM 13 stores programs. The CPU 11 executes processing in accordance with the programs stored in the ROM 13, thereby performs overall control of each section in the image forming system 1.

The RAM 15 is used as a work area when the CPU 11 executes processing. The NVRAM 17 is an electrically rewritable memory and may be a flash memory or an EEPROM. The NVRAM 17 stores data that needs to be kept even during power off.

The communication interface 20 is configured to perform data communication with an external apparatus, and receives print target data from the external apparatus, for example. In accordance with commands from the main controller 10, the print controller 30 controls conveyance of a carriage 61 on which a recording head 50 is mounted, and further controls an ink ejection operation by the recording head 50. Due to this control, the print controller 30 forms an image based on print target data on paper Q. In one example, the print controller 30 and the conveyance controller 40 are formed as an ASIC.

As elements relating to an image formation operation, the image forming system 1 includes the recording head 50, an ink tank 51, a head driving circuit 55, a carriage conveyance mechanism 60, a CR (carriage) motor 71, a motor driving circuit 73, an encoder 75, and a signal processing circuit 77 in addition to the print controller 30.

The recording head 50 is an inkjet head that ejects ink toward paper Q. The recording head 50 is mounted on the carriage 61. The recording head 50 is connected to the ink tank 51 that is not mounted on the carriage 61 through a tube (not shown), and operates by receiving ink supply from the ink tank 51. The recording head 50 is also connected to a signal line (not shown).

The head driving circuit 55 is configured to drive the recording head 50 in accordance with control signals inputted from the print controller 30. The carriage conveyance mechanism 60 is configured to cause the carriage 61 to reciprocate along the main scanning direction by transmitting power from the CR motor 71 to the carriage 61. The detailed configuration of the carriage conveyance mechanism 60 will be described while referring to FIG. 2.

The CR motor 71 may be a direct-current motor. The motor driving circuit 73 drives the CR motor 71 by PWM control. Specifically, the motor driving circuit 73 applies, to the CR motor 71, a drive current in accordance with an input signal from the print controller 30, and drives the CR motor 71.

The encoder 75 is a linear encoder configured to output encoder signals depending on displacement of the carriage 61 in the main scanning direction. The signal processing circuit 77 detects the position and velocity of the carriage 61 in the main scanning direction, based on encoder signals inputted from the encoder 75. The position and velocity of the carriage 61 detected by the signal processing circuit 77 are inputted to the print controller 30.

The print controller 30 determines a manipulated variable for the CR motor 71 such that the carriage 61 moves in accordance with a target position and a velocity locus that follows a command from the main controller 10, based on the position and velocity of the carriage 61 inputted from the signal processing circuit 77, and inputs a corresponding control signal to the motor driving circuit 73, thereby controlling the CR motor 71. With this operation, the print controller 30 controls the CR motor 71 so as to realize conveyance control that follows the command from the main controller 10.

Further, the print controller 30 inputs, to the head driving circuit 55, a control signal for realizing ink ejection control corresponding to input data from the main controller 10, based on the position of the carriage 61 inputted from the signal processing circuit 77. With this operation, the recording head 50 ejects ink, onto paper Q, for forming an image corresponding to print target data at appropriate timing.

The conveyance controller 40 controls a PF (paper feed) motor 91 in accordance with commands from the main controller 10, thereby controlling conveyance of paper Q. As elements relating to conveyance of paper Q, the image forming system 1 includes a paper conveyance mechanism 80, the PF motor 91, a motor driving circuit 93, an encoder 95, and a signal processing circuit 97.

The paper conveyance mechanism 80 receives power from the PF motor 91 and causes a conveyance roller 81 to rotate, thereby conveying paper Q in a sub-scanning direction perpendicular to the main scanning direction. With this operation, the paper conveyance mechanism 80 feeds paper Q, by a particular amount at a time, to a position in the sub-scanning direction at which the recording head 50 reciprocates.

The PF motor 91 may be a direct-current motor. The motor driving circuit 93 applies, to the PF motor 91, a drive current in accordance with an input signal from the conveyance controller 40, thereby driving the PF motor 91.

The encoder 95 is a rotary encoder provided at a rotational shaft of the PF motor 91 or the conveyance roller 81 and configured to output encoder signals depending on rotation of the PF motor 91 or the conveyance roller 81.

The signal processing circuit 97 detects a rotation amount and a rotation velocity of the conveyance roller 81 based on the encoder signal inputted from the encoder 95. The rotation amount and the rotation velocity of the conveyance roller 81 correspond to the conveyance amount and the conveyance velocity of paper Q conveyed due to rotation of the conveyance roller 81.

The rotation amount and the rotation velocity detected by the signal processing circuit 97 are inputted to the conveyance controller 40. The conveyance controller 40 determines a manipulated variable for the PF motor 91 based on the rotation amount and the rotation velocity detected by the signal processing circuit 97, and controls the PF motor 91. With this operation, the conveyance controller 40 controls rotation of the conveyance roller 81, thereby controlling conveyance of paper Q.

Figure 2:
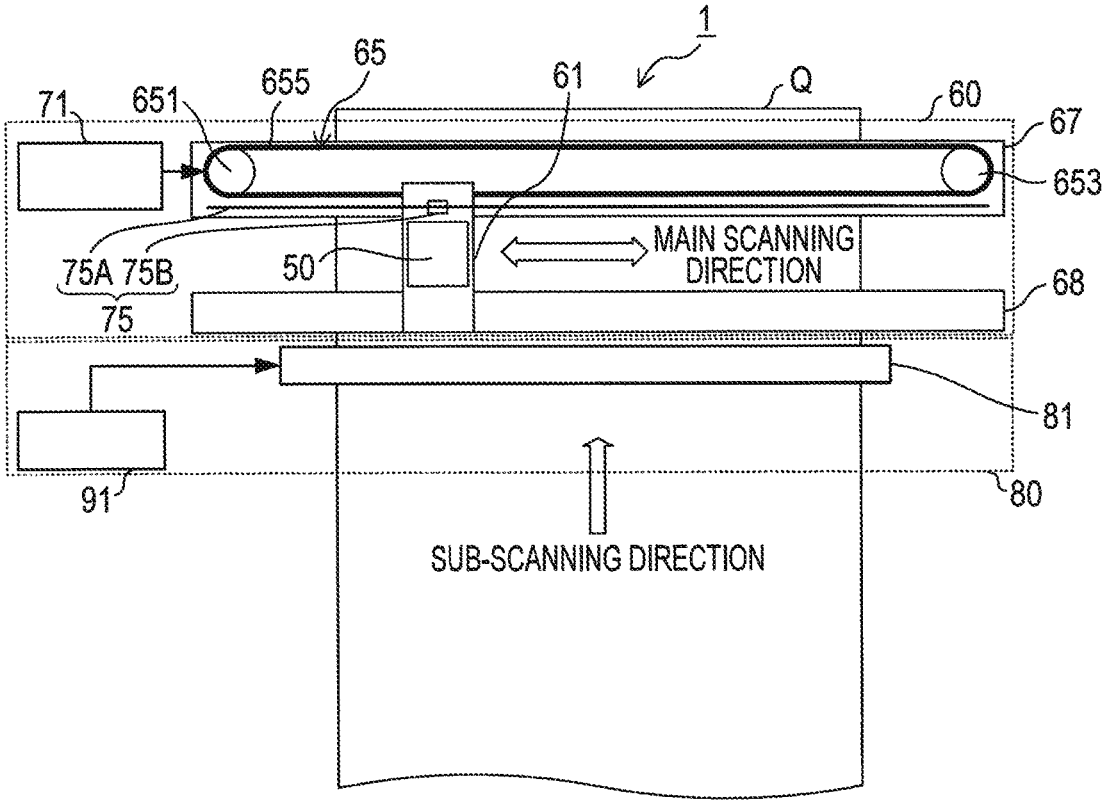
FIG. 2 is a diagram showing the configuration of a carriage conveyance mechanism and a paper conveyance mechanism.

As shown in FIG. 2, the carriage conveyance mechanism 60 includes the carriage 61, a belt mechanism 65, and guide rails 67, 68. The belt mechanism 65 includes a drive pulley 651 and a follow pulley 653 arranged in the main scanning direction, and a belt 655 looped between the drive pulley 651 and the follow pulley 653. The carriage 61 is fixed to the belt 655. In the belt mechanism 65, the drive pulley 651 rotates by receiving power from the CR motor 71, and the belt 655 and the follow pulley 653 rotate by following rotation of the drive pulley 651.

The guide rails 67, 68 extend along the main scanning direction, and arranged at positions away from each other in the sub-scanning direction. The belt mechanism 65 is disposed at the guide rail 67. For example, a protruding wall (not shown) extending along the main scanning direction is formed on the guide rails 67, 68 in order to regulate the movement direction of the carriage 61 in the main scanning direction.

In a state where the movement direction of the carriage 61 is regulated by the guide rails 67, 68, the carriage 61 reciprocates on the guide rails 67, 68 along the main scanning direction in conjunction with rotation of the belt 655. The recording head 50 is mounted on the carriage 61, and moves in the main scanning direction due to movement of the carriage 61.

The conveyance roller 81 is arranged to be parallel with the main scanning direction at an upstream side of the recording head 50 in the sub-scanning direction. The conveyance roller 81 rotates by receiving power from the PF motor 91 and, by this rotation, conveys paper Q conveyed from the upstream side to the downstream side in the sub-scanning direction.

Specifically, the conveyance roller 81 is indirectly controlled by the conveyance controller 40 through the PF motor 91, and intermittently and repeatedly executes an operation of rotating by a particular amount, thereby conveying paper Q to the downstream side in the sub-scanning direction by a particular amount at time. The paper conveyance mechanism 80 includes a paper feed roller (not shown) at the upstream side of the conveyance roller 81. The paper feed roller picks up paper Q from a tray and conveys the paper Q to the downstream side.

As shown in FIG. 2, the encoder 75 includes an encoder scale 75A and an optical sensor 75B. The encoder scale 75A is disposed at the guide rail 67 along the main scanning direction. The optical sensor 75B is mounted on the carriage 61. The encoder 75 inputs, to the signal processing circuit 77, encoder signals depending on change of a relative position between the encoder scale 75A and the optical sensor 75B.

Each unit of the above-described image forming system 1 operates by receiving power supply from a common power supply 99 provided in the image forming system 1. For example, the CR motor 71 and the PF motor 91 operate by receiving power supply from the common power supply 99 through the motor driving circuits 73, 93.

Figure 3:
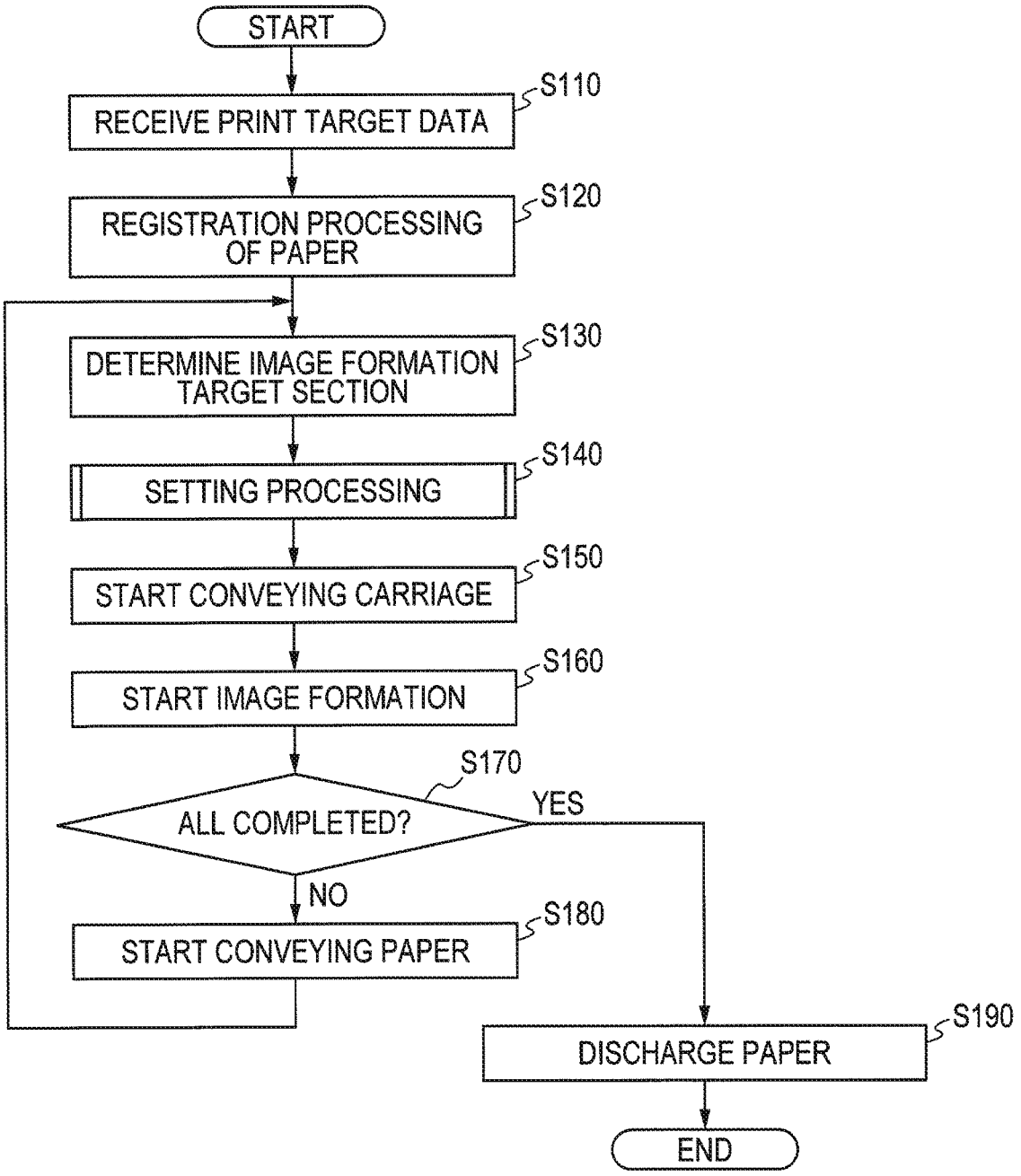
FIG. 3 is a flowchart showing processing that is executed by a main controller in response to receiving a print command.

Next, the details of processing executed by the main controller 10 in response to receiving a print command from the external apparatus through the communication interface 20 will be described while referring to FIG. 3. As shown in FIG. 3, in response to receiving a print command, the main controller 10 receives print target data from the external apparatus (S110), and executes registration processing of paper Q (S120).

In registration processing, the main controller 10 inputs a command to the conveyance controller 40 such that the paper conveyance mechanism 80 conveys paper Q to the downstream side in the sub-scanning direction and a leading end of an image formation target region of paper Q in the sub-scanning direction is located below the recording head 50.

The main controller 10 sets, to the conveyance controller 40, a target profile indicative of the target position and the velocity locus of the conveyance roller 81, and causes the conveyance controller 40 to control the PF motor 91 such that the conveyance roller 81 rotates in accordance with the position and the velocity locus that follows the target profile, thereby realizing registration of paper Q.

In response to completing the registration processing, in the following S130-S180, the main controller 10 forms an image based on print target data on paper Q by repeatedly performing operations of causing the carriage conveyance mechanism 60 to convey the recording head 50 to the turn position by one pass along the main scanning direction, in the conveyance process of the recording head 50, causing the recording head 50 to eject ink toward paper Q in a stopped state, and, after the recording head 50 ends ink ejection, causing the paper conveyance mechanism 80 to convey the paper Q by a particular amount in the sub-scanning direction.

That is, the main controller 10 forms an image based on print target data on paper Q by, while intermittently conveying the paper Q by the particular amount, causing, during a stop period of the paper Q, the recording head 50 to perform an image formation operation for one pass along the main scanning direction. The conveyance amount of paper Q during intermittent conveyance (the above-mentioned particular amount) corresponds to a width of an image, in the sub-scanning direction, formed by this image formation operation for one pass.

In the following description, the conveyance operation and image formation operation of the recording head 50 for one pass when forming an image on paper Q by reciprocation of the carriage 61 with intermittent conveyance of the paper Q are referred to as "conveyance operation for one pass" and "image formation operation for one pass".

That is, a conveyance operation for one pass of the recording head 50 (the carriage 61) corresponds to an operation of conveying the recording head 50 from the stop position to the turn position one way along the main scanning direction, and an image formation operation for one pass corresponds to an ink ejection operation that is performed during the conveyance operation for one pass of the recording head 50. The conveyance operation for one pass of paper Q corresponds to an operation of conveying paper Q to the downstream side in the sub-scanning direction by the particular amount, the operation being performed between an image formation operation for one pass and an image formation operation for the next one pass.

That is, in S130-S180, the main controller 10 sequentially forms, on paper Q, an image based on print target data by one pass at a time, by repeatedly performing the conveyance operation for one pass of the carriage 61, the image formation operation for one pass, and the conveyance operation for one pass of paper Q, which are overlapped partially.

In S130, the main controller 10 determines an image formation target section of the current pass and an image formation target section of the next pass based on print target data. The image formation target section of the current pass corresponds to a section in the main scanning direction in which an ink ejection operation is performed during the conveyance operation for one pass of the carriage 61 that is started immediately. The image formation target section of the next pass corresponds to a section in the main scanning direction in which an ink ejection operation is performed during the conveyance operation for one pass of the carriage 61 that is performed next time.

Specifically, the main controller 10 determines an image formation start position and an image formation end position as the image formation target section. The image formation start position corresponds to a position of the carriage 61 in the main scanning direction at which the recording head 50 starts an ink ejection operation, that is, an ink ejection start position. The image formation end position corresponds to a position of the carriage 61 in the main scanning direction at which the recording head 50 ends an ink ejection operation, that is, an ink ejection end position.

Upon ending processing in S130, the main controller 10 moves to S140 and executes setting processing of which details will be described later. In the setting processing, the main controller 10 sets a carriage stop position that is the turn position of the carriage 61, based on the image formation end position of the current pass and the image formation start position of the next pass, and further sets, as a deceleration start position, a point that is an upstream side from the carriage stop position by a particular distance in the conveyance direction of the carriage 61. The main controller 10 further sets conveyance start timing of paper Q.

Figure 4:
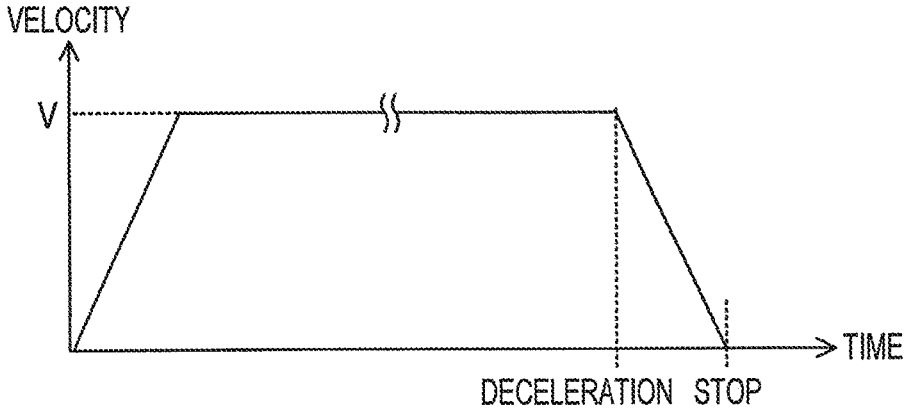
FIG. 4 is a graph of velocity with respect to time showing a velocity locus of the carriage.
Figure 5:
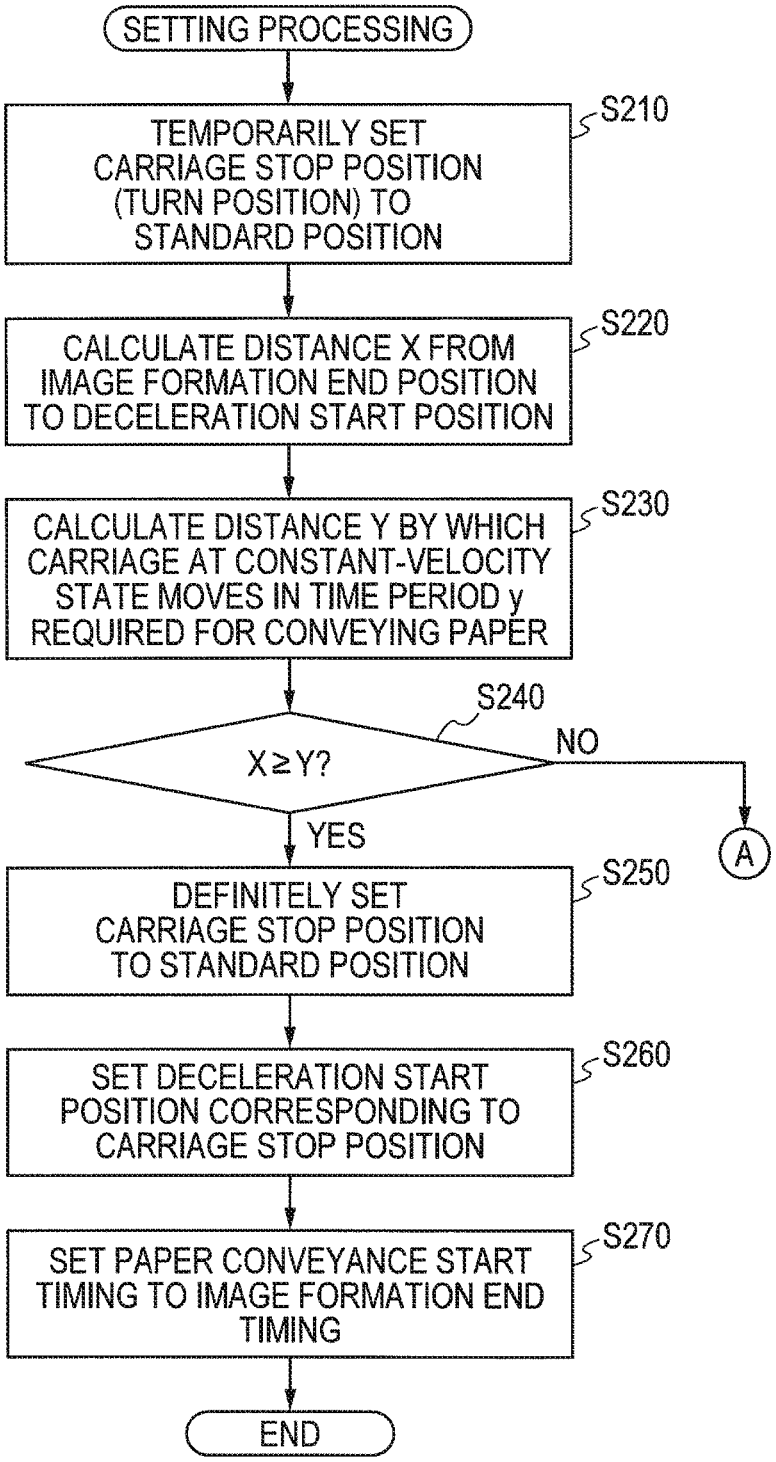
FIG. 5 is a flowchart showing setting processing (a first part) that is executed by a main controller according to a first embodiment.
Figure 6:
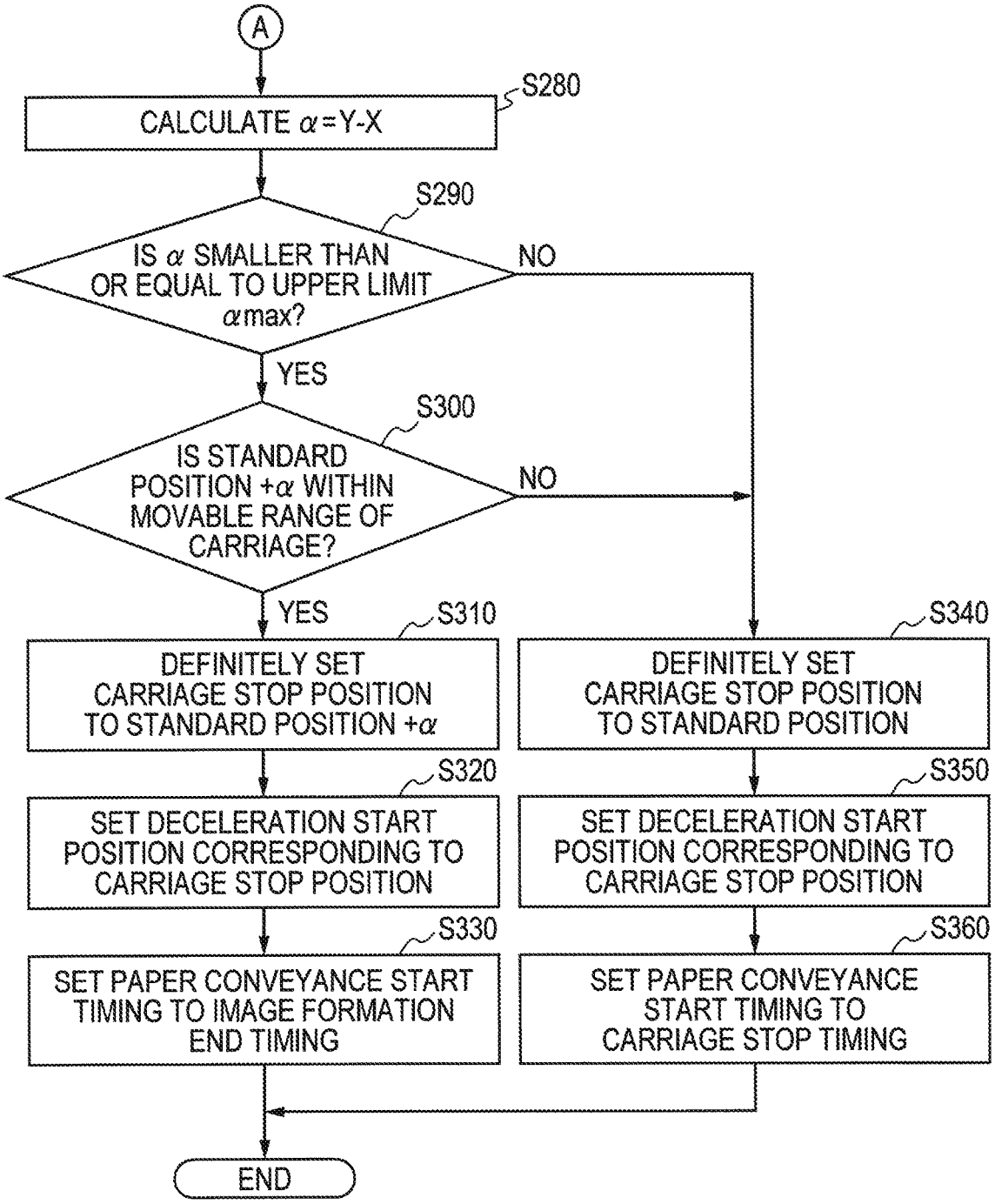
FIG. 6 is a flowchart showing the setting processing (a second part) that is executed by the main controller according to the first embodiment.

In S150, the main controller 10 sets, to the print controller 30, a target profile indicative of the target position and the velocity locus, and, as shown in FIG. 4, for example, causes the print controller 30 to control the carriage conveyance mechanism 60 (the CR motor 71) such that the carriage 61 accelerates from the current position to a particular velocity V, then moves at the particular velocity V (constant velocity) to a deceleration start position, starts deceleration at the deceleration start position, and stops at a carriage stop position in accordance with the target profile.

In S160, the main controller 10 inputs, to the print controller 30, data necessary for the image formation operation of the current pass created from the print target data, and causes the print controller 30 to control the recording head 50 such that the recording head 50 performs an image formation operation for one pass corresponding to the current pass in the image formation target section from the image formation start position to the image formation end position in which the carriage 61 moves at a constant velocity. As in a known inkjet printer, in order to control an ink landing point on paper Q, an image formation operation (that is, an ink ejection operation) is performed on stopped paper Q in a state where the carriage 61 is conveyed at a constant velocity. That is, the image formation target section is within a constant-velocity conveyance section of the carriage 61.

After that, the main controller 10 determines whether image formation operations for a plurality of passes corresponding to print target data received in S110 are all completed in the last S160 processing (S170). In response to determining that the image formation operations are all completed (S170: Yes), the main controller 10 executes paper discharge processing (S190) after the conveyance operation and the image formation operation for one pass in S150 and S160 end. In the paper discharge processing, the conveyance controller 40 controls the PF motor 91 such that paper Q is discharged from the paper conveyance mechanism 80. Then, the processing shown in FIG. 3 ends.

In response to determining that the image formation operations are not completed (S170: No), the main controller 10 inputs a command to the conveyance controller 40 such that the paper conveyance mechanism 80 starts conveyance of paper Q in the sub-scanning direction by the particular amount when the conveyance start timing of paper Q set in S140 has come (S180).

Specifically, the main controller 10 may set, to the conveyance controller 40, a target profile indicative of the target position and the velocity locus of the conveyance roller 81 for conveying paper Q by the particular amount, and cause the conveyance controller 40 to start control of the PF motor 91 in accordance with the set target profile when it is detected that the conveyance start timing of paper Q has come. With this operation, at timing when the conveyance start timing set as described above has come, paper conveyance is started.

Detection that the conveyance start timing of paper Q has come may be realized by receiving information necessary for detection from the print controller 30. The conveyance start timing of paper Q corresponds to timing at which the recording head 50 passes the image formation end position or timing at which the recording head 50 reaches the carriage stop position and stops. Thus, the main controller 10 detects that the conveyance start timing of paper Q has come by acquiring positional information of the carriage 61 through the print controller 30.

After executing processing of S180, the main controller 10 moves to S130 and determines the image formation target section by the image formation operation for one pass executed in subsequent S160 and also the image formation target section of the next pass. After ending the setting processing (S140) based on these image formation target sections, the main controller 10 executes processing of S150 and causes the carriage conveyance mechanism 60 to start conveyance of the carriage 61.

In S150, in a case where the conveyance operation of paper Q started in the processing of immediately preceding S180 has not ended, the main controller 10 causes the carriage conveyance mechanism 60 to start conveyance of the carriage 61 after waiting until the conveyance operation of paper Q ends.

In this way, the main controller 10 forms an image based on print target data on paper Q by repeatedly performing the conveyance operation of the carriage 61 for one pass, the image formation operation for one pass, and the conveyance operation of paper Q for one pass that are partially overlapped.

Figure 7:
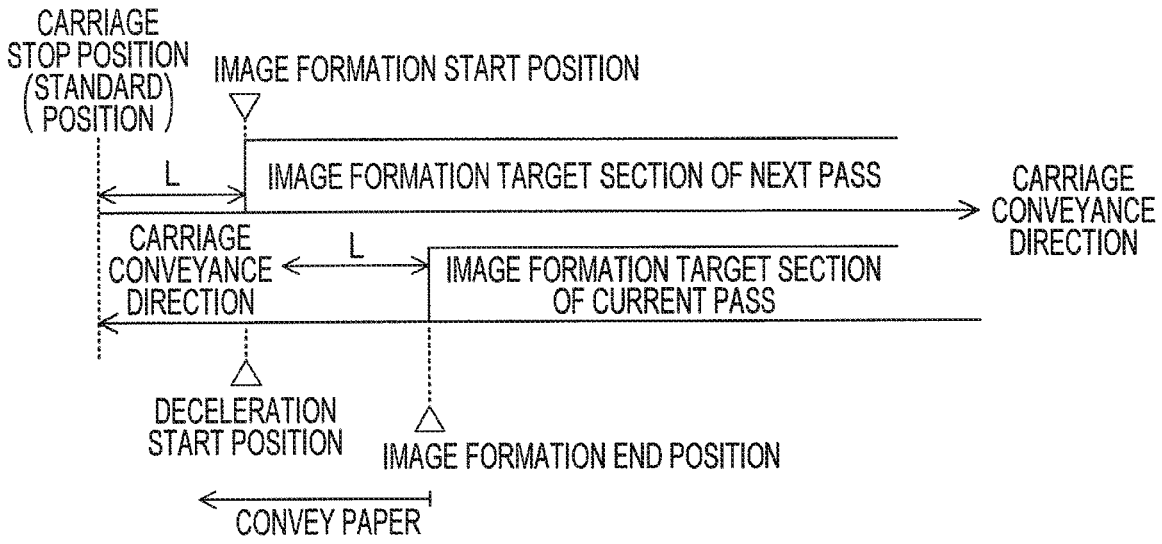
FIG. 7 is an explanatory diagram relating to a carriage stop position.

Next, details of the setting processing executed by the main controller 10 will be described while referring to FIGS. 5 to 8. Upon starting setting processing shown in FIG. 5 in S140 (FIG. 3), the main controller 10 temporarily sets the carriage stop position to a standard position (S210). As shown in FIG. 7, the standard position is set to a position that is located at a farther downstream side in the conveyance direction of the carriage 61 among a position away from the image formation end position of the current pass by a reference distance L in the conveyance direction of the carriage 61 and a position away from the image formation start position of the next pass by the reference distance L in the same direction.

The reference distance L corresponds to an acceleration distance in which the carriage 61 accelerates from a stop state to a particular velocity and shifts to a constant velocity state and a deceleration distance in which the carriage 61 moving at the particular velocity (in a constant velocity state) decelerates and stops. The acceleration distance and the deceleration distance are basically the same.

In the present embodiment, it is a basic operation that, when performing an image formation on paper Q, the carriage 61 is reciprocated such that the carriage 61 turns at a standard position. Further, it is a basic operation that the paper Q is conveyed by a particular amount in the sub-scanning direction at timing when an image formation operation by the recording head 50 (ink ejection operation) ends, in other words, at timing when the carriage 61 passes the image formation end position.

In the present embodiment, however, the common power supply 99 of small size is used for cost reduction, and the upper limit of a suppliable current from the common power supply 99 is small. Thus, the CR motor 71 and the PF motor 91 cannot be operated concurrently in such a manner that the peak of driving current of the CR motor 71 during deceleration of the carriage 61 and the peak of driving current of the PF motor 91 during conveyance of paper Q overlap in the same period.

Thus, in the setting processing in the present embodiment, in a case where the peaks of the driving currents overlap if conveyance operations of the carriage 61 and paper Q are performed in accordance with the above-mentioned basic operation by processing of S220 and thereafter, various settings are performed so as to change the basic operation. Specifically, various settings are performed such that a conveyance period of paper Q and a deceleration period of the carriage 61 do not overlap.

Upon ending temporary setting of the standard position in S210, the main controller 10 calculates a distance X from the image formation end position of the current pass to the deceleration start position in the main scanning direction in a case where the carriage stop position is the standard position (S220). The deceleration start position corresponds to a position away from the standard position by the reference distance L to the upstream side. The distance X indicates a positional relationship between the image formation end position and the deceleration start position.

Further, the main controller 10 calculates a distance Y in which the carriage 61 in the constant velocity state moves in a time period y. The time period y is a time period that is required for conveying paper Q by the particular amount (S230). Assuming that the velocity of the carriage 61 in the constant velocity state is V, the distance Y is calculated by an expression Y=V·y. The time period y is calculated theoretically as a driving time period of the PF motor 91 when paper Q is conveyed by the particular amount in accordance with the target profile.

In S240, the main controller 10 determines whether the distance X is larger than or equal to the distance Y. In response to determining that the distance X is larger than or equal to the distance Y (S240: Yes), the main controller 10 moves to S250. In response to determining that the distance X is smaller than the distance Y (S240: No), the main controller 10 moves to S280 (see FIG. 6).

Figure 8A:
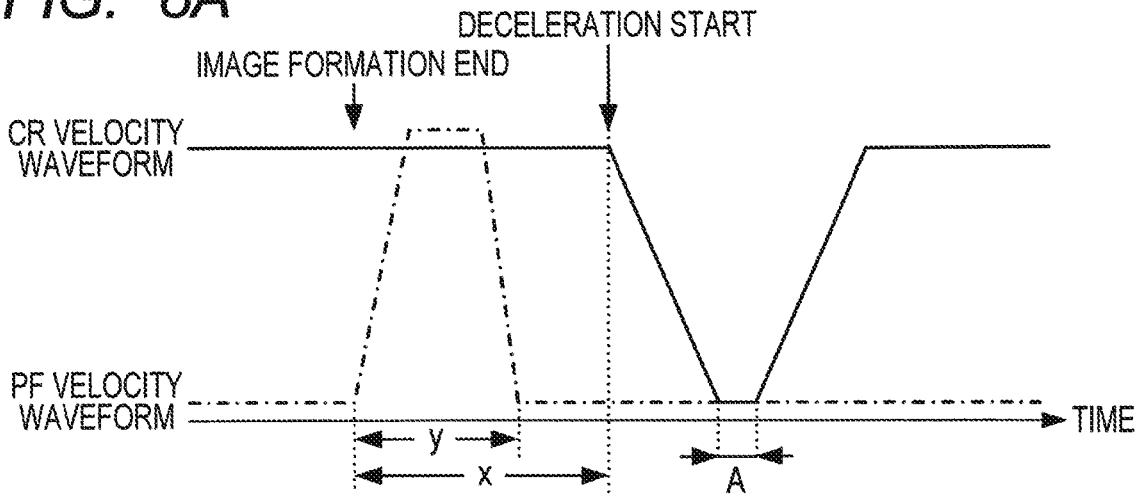
FIGS. 8A to 8C are explanatory diagrams for showing examples of deceleration of the carriage and conveyance of paper in the first embodiment.

As shown in FIG. 8A, in a case where the distance X is larger than distance Y, even if conveyance of paper Q is started at the end timing of an image formation operation, the carriage 61 does not reach the deceleration start position before a conveyance operation of paper Q is completed.

A time period x shown in FIG. 8A is a time period corresponding to the distance X, that is, a time period required for the carriage 61 to move from the image formation end position to the deceleration start position. The CR velocity waveform shown by the solid lines in FIGS. 8A-8C indicates the velocity waveform of the CR motor 71, in other words, the velocity waveform of the carriage 61. The PF velocity waveform shown by the single-dot chain lines indicates the velocity waveform of the PF motor 91, in other words, the velocity waveform of the conveyance roller 81. It should be understood that the CR velocity waveform and the PF velocity waveform schematically show acceleration and deceleration and are not identical to the actual velocity waveforms.

As can be understood from FIG. 8A, when the distance X is larger than or equal to the distance Y (distance X≥distance Y), the deceleration period of the carriage 61 and the conveyance period of paper Q do not overlap when the above-mentioned basic operation is performed. Hence, in S250, the main controller 10 definitely sets the carriage stop position to the standard position (S250), and sets the deceleration start position to the position away from the carriage stop position by the reference distance L to the upstream side (S260).

Further, the main controller 10 sets the conveyance start timing of paper Q to the end timing of the image formation operation of the carriage 61 (S270). After that, the main controller 10 ends the setting processing (S140).

In this way, in the processing of S150 to S180 after setting the carriage stop position, the deceleration start position and the paper conveyance start timing, as shown in FIG. 8A, the conveyance operation of paper Q by the particular amount is started at timing when the carriage 61 passes the image formation end position, deceleration of the carriage 61 is started at timing when the carriage 61 passes the deceleration start position after the conveyance operation of paper Q ends, and the carriage 61 is stopped at the standard position. After a requisite minimum time A required for turning elapses, the carriage 61 turns at the standard position and is conveyed in the opposite direction along the main scanning direction.

Figure 8B:
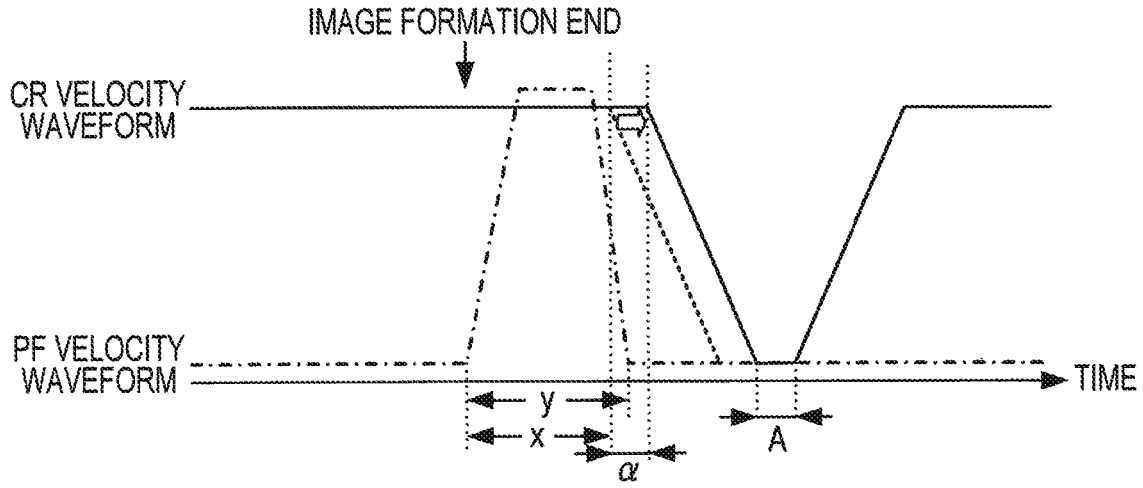

In response to moving to S280 (see FIG. 6), the main controller 10 calculates a difference α=Y−X between the distance Y and the distance X. In the present embodiment, in a case where the distance X is smaller than the distance Y, as shown in FIG. 8B, in the processing of S290 and thereafter, the main controller 10 determines whether it is appropriate to shift the carriage stop position from the standard position by the difference α to the downstream side in the conveyance direction of the carriage 61, and thereby to shift the deceleration start position by the difference α to the downstream side. When it is determined that it is appropriate, shifting the deceleration start position and the carriage stop position by the difference α creates a state equivalent to that the distance X is larger than or equal to the distance Y. The difference α is used for this determination and shift. In the following description, this shift of the carriage stop position and the deceleration start position is also referred to as "position shift".

In S290, the main controller 10 determines whether the difference α is smaller than or equal to an upper limit αmax. The upper limit αmax is defined by the expression below. The symbol "·" is a multiplication symbol, and the symbol "/" is a division symbol.

$$\alpha\max=(B-A)\cdot V/2 \tag{1}$$

The upper limit αmax corresponds to a maximum value of the difference α that satisfies a relationship that a first time T1 is smaller than or equal to a second time T2. The first time T1 and the second time T2 are shown below.

$$T1=\alpha/V+D+A+D+\alpha/V \tag{2}$$

$$T2=D+B+D \tag{3}$$

The value D is an acceleration-deceleration time of the carriage 61. The value A is a requisite minimum time A required for turning of the carriage 61, that is, corresponds to a minimum time A in which the carriage 61 keeps stopping at the carriage stop position at the time of turning. The value V is a velocity of the carriage 61 in the constant velocity state.

That is, the first time T1 corresponds to a time period required from timing when the carriage 61 passes the image formation end position until timing when the carriage 61 reaches the image formation start position of the next pass for starting an image formation operation, when the deceleration start position and the carriage stop position are shifted by the difference α.

In the right side of the above expression (2), the value $\alpha/V$ of the first term corresponds to a period in the constant velocity state of the carriage 61 that is extended by the position shift, the value D of the second term corresponds to a deceleration period from deceleration to stop of the carriage 61, the value A of the third term corresponds to a period required for turning of the carriage 61, the value D of the fourth term corresponds to an acceleration period in which the carriage 61 shifts to the constant velocity state after turning, and the value $\alpha/V$ of the fifth term corresponds to a period of the constant velocity state after turning of the carriage 61 that is extended by the position shift.

The second time T2 corresponds to a time period required from timing when the carriage 61 passes the image formation end position until timing when the carriage 61 reaches the image formation start position of the next pass for starting an image formation operation in a case where paper conveyance immediately after the end of the image formation operation is deferred until the carriage 61 reaches the carriage stop position (standard position) without performing the above-mentioned position shift.

The value B corresponds to a stop time of the carriage 61 at the carriage stop position (standard position) in a case where the paper conveyance is deferred as described above. In addition, the expression (2) and the expression (3) are numerical expressions of time T1, T2 in a case where the carriage 61 is turned at the standard position and an image formation operation is started immediately after the carriage 61 shifts to the constant velocity state.

Here, because the difference between the first time T1 and the second time T2 is expressed as $T2-T1=B-A-2\cdot\alpha/V$, it can be understood that a maximum value $\alpha max$ of the difference $\alpha$ that satisfies the relationship that the first time T1 is smaller than or equal to the second time T2 (that is, $T2-T1\geq 0$) is as shown in the expression (1).

That is, in S290, by determining whether the difference $\alpha$ is smaller than or equal to the upper limit $\alpha max$, it is determined in which case the print time for completing the image formation operation on paper Q is shorter (more specifically, the carriage 61 reaches the image formation start position of the next pass at earlier timing in the conveyance process of the carriage 61 from the image formation end position of the current pass), among a case where a position shift is performed or a case where paper conveyance is deferred. In a case where the difference $\alpha$ is smaller than or equal to the upper limit $\alpha max$, the print time is shorter and throughput is better when the position shift is performed.

In response to determining that the difference $\alpha$ is smaller than or equal to the upper limit $\alpha max$ (S290: Yes), the main controller 10 determines whether the carriage stop position is within the movable range of the carriage 61 when the carriage stop position is shifted from standard position by the difference $\alpha$ to the downstream side in the conveyance direction of the carriage 61 (S300).

In response to determining that the carriage stop position is within the movable range (S300: Yes), the main controller 10 definitely sets the carriage stop position to the position shifted from the standard position by the difference $\alpha$ to the downstream side in the conveyance direction of the carriage 61 (S310), and sets the deceleration start position to the position away from the carriage stop position to the upstream side by the reference distance L (S320). Further, the main controller 10 sets the paper conveyance start timing to the end timing of the image formation operation of the carriage 61 (S330). After that, the setting processing ends (S140).

In the processing of S150 to S180 after the carriage stop position, the deceleration start position, and the paper conveyance start timing are set in this way, as shown in FIG. 8B, the conveyance operation of paper Q by the particular amount is performed at timing when the carriage 61 passes the image formation end position, deceleration of the carriage 61 is started at timing when the carriage 61 passes the deceleration start position changed by the position shift after the conveyance operation of paper Q ends, and the carriage 61 is stopped at the position shifted from the standard position by the difference $\alpha$ to the downstream side. After the requisite minimum time A required for turning elapses, the carriage 61 returns from the stop position and is conveyed in the opposite direction along the main scanning direction.

The slanted line shown by the dashed line in FIG. 8B schematically shows a velocity locus during deceleration of the carriage 61 in a case where no position shift is performed. As can be understood from this figure, the conveyance period of paper Q and the deceleration period of the carriage 61 have an overlapping period in a case where no position shift is performed, but this overlap is avoided by the position shift.

In response to determining that the difference $\alpha$ is larger than the upper limit $\alpha max$ (S290: No), or in response to determining that the carriage stop position after position shift is not within the movable range of the carriage 61 (S300: No), the main controller 10 definitely sets the carriage stop position to the standard position (S340), and sets the deceleration start position to the position away from the carriage stop position by the reference distance L to the upstream side (S350). Further, the main controller 10 sets the paper conveyance start timing to the stop timing of the carriage 61 (S360). After that, the setting processing ends (S140).

Figure 8C:
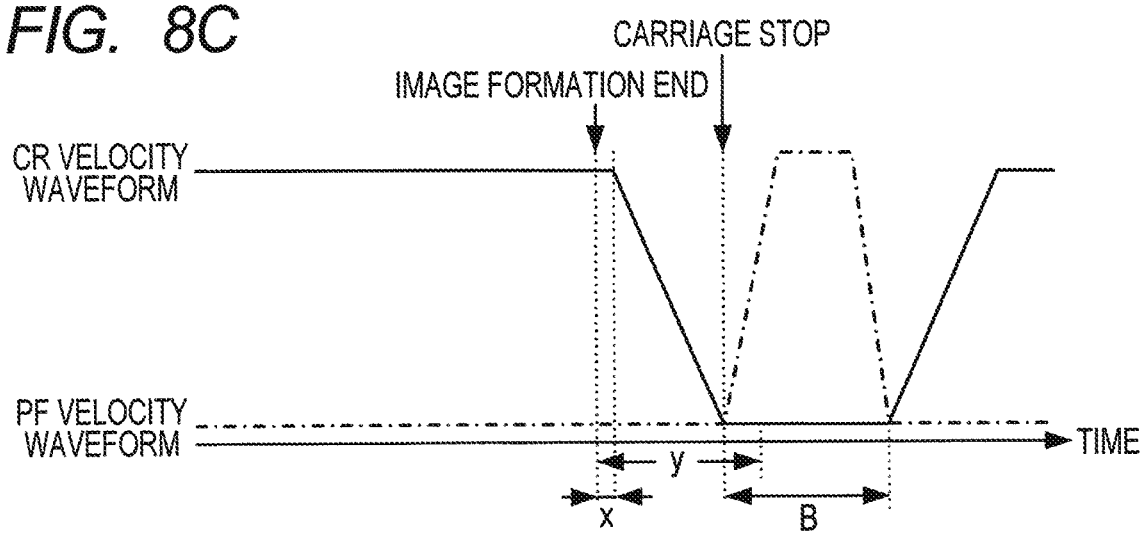

In the processing of S150 to S180 after the carriage stop position, the deceleration start position, and the paper conveyance start timing are set in this way, as shown in FIG. 8C, the conveyance operation of paper Q by the particular amount is not performed at timing when the carriage 61 passes the image formation end position, deceleration of the carriage 61 is started without performing the conveyance operation of paper Q, and the carriage 61 is stopped at the standard position. After that, the conveyance operation of paper Q by the particular amount is performed and, at timing when the conveyance operation of paper Q ends, the carriage 61 returns from the standard position and is conveyed in the opposite direction along the main scanning direction.

According to the image forming system 1 of the present embodiment described above, the CR motor 71 and the PF motor 91 are driven such that the deceleration period of the carriage 61 and the conveyance period of paper Q do not overlap. Thus, even in a case where the CR motor 71 and the PF motor 91 are driven by using the common power supply 99 having a small upper limit of suppliable current, it is prevented that the conveyance control of the carriage 61 and paper Q that follows the target profile becomes impossible due to power shortage.

Particularly, in the present embodiment, by selecting either one of a method of changing the carriage stop position and the deceleration start position and a method of deferring paper conveyance, it is set such that the deceleration period of the carriage 61 and the conveyance period of paper Q do not overlap. The selection of the method is performed in consideration of print time, in other words, throughput.

In the present embodiment, adjustments are performed in a direction of reducing an overlap between the conveyance period of the paper Q and the deceleration period of the recording head 50 after the recording head 50 passes the ejection end position. Thus, the amount of currents that need to be supplied concurrently to the CR motor 71 and the PF motor 91 can be suppressed.

Thus, in the present embodiment, when a plurality of conveyance mechanisms (specifically, the CR motor 71 and the PF motor 91) is operated by using power supply from the common power supply 99 of a small type having a relatively small suppliable current, the common power supply 99 is utilized efficiently to form images on paper Q.

In the present embodiment, the main controller 10 adjusts the timing of conveyance of paper Q or the turn position of the carriage 61 such that the conveyance period of paper Q and the deceleration period of the recording head 50 do not overlap. According to this adjustment method, with relatively simple adjustments, the plurality of conveyance mechanisms can be operated such that the driving currents of the conveyance mechanisms do not exceed the upper limit the suppliable current of the common power supply 99.

Thus, in the present embodiment, by adopting the common power supply 99 of small size, while reducing manufacturing costs of the product, an increase of print time and degradation of throughput can be suppressed efficiently. Hence, the image forming system 1 of high performance can be manufactured with reduced cost.

In the above-described embodiment, an overlap between the deceleration period of the carriage 61 and the conveyance period of paper Q is avoided. However, it is unnecessary to avoid such overlap completely, and the overlap may be avoided partially.

For example, the deceleration period and the conveyance period may overlap partially as long as the total value of currents that need to be supplied to the CR motor 71 and the PF motor 91 in the same period is smaller than or equal to the upper limit of the common power supply 99. In order to suppress the total value so as to be smaller than or equal to the upper limit, for example, as will be described in a second embodiment, the carriage stop position or the paper conveyance start timing may be adjusted such that a peak period of driving current of the CR motor 71 and a peak period of driving current of the PF motor 91 do not overlap.

Second Embodiment

Figure 10:
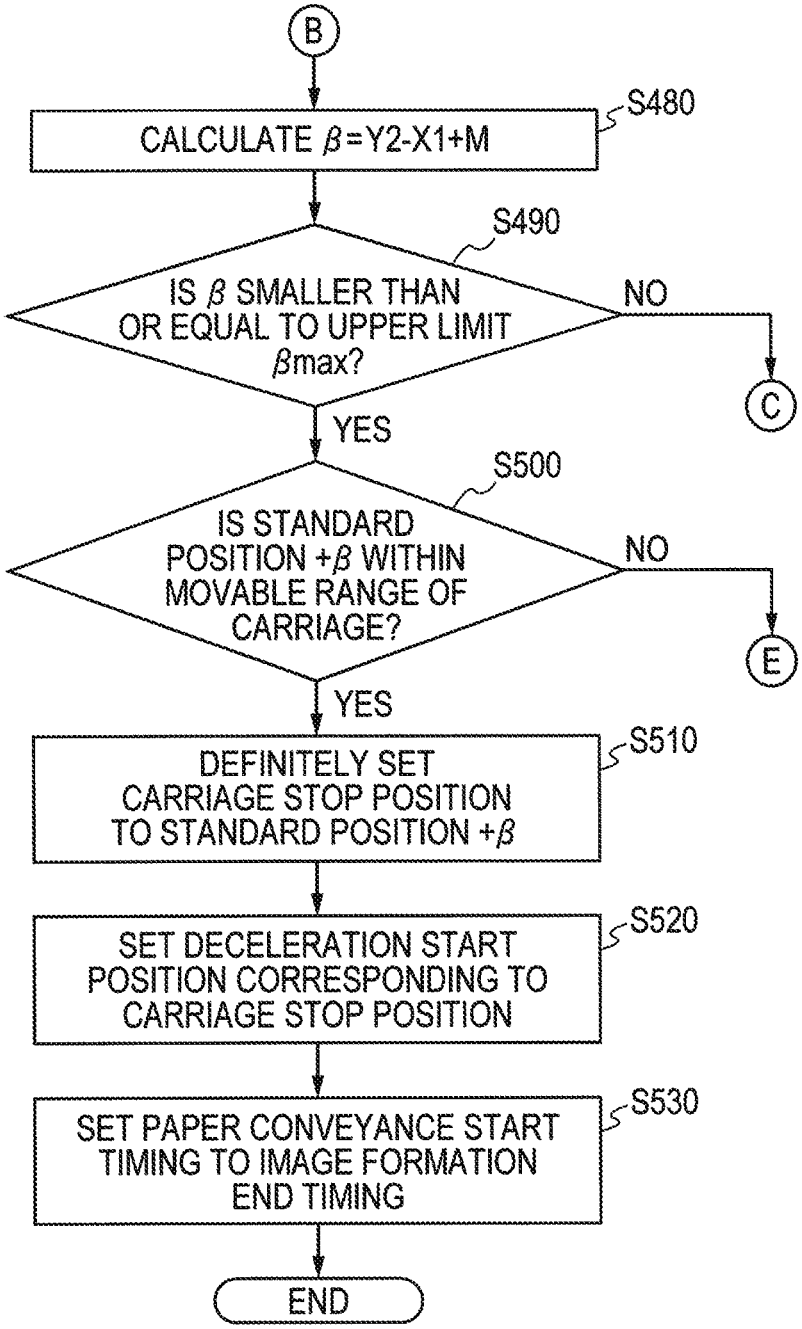
FIG. 10 is a flowchart showing the setting processing (a second part) that is executed by the main controller according to the second embodiment.
Figure 11:
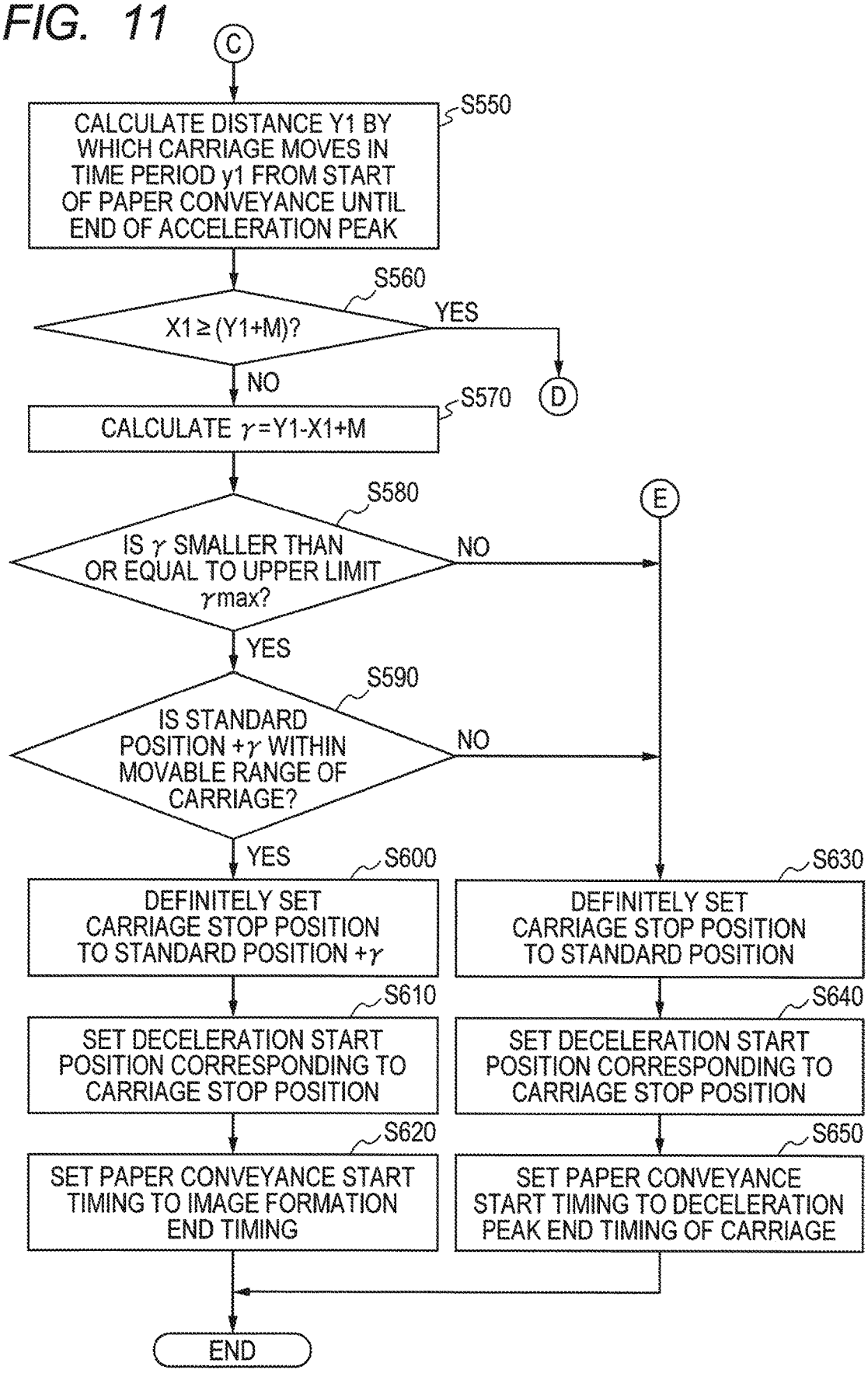
FIG. 11 is a flowchart showing the setting processing (a third part) that is executed by the main controller according to the second embodiment.

Next, an image forming system 1 of the second embodiment will be described. The image forming system 1 of the second embodiment is different from the image forming system 1 of the first embodiment in that the main controller 10 executes setting processing shown in FIGS. 9 to 11 instead of the setting processing shown in FIGS. 5 and 6, and the second embodiment is basically same as the first embodiment in other point. Thus, in the following description of the second embodiment, the details of the setting processing executed by the main controller 10 will be described selectively.

Figure 9:
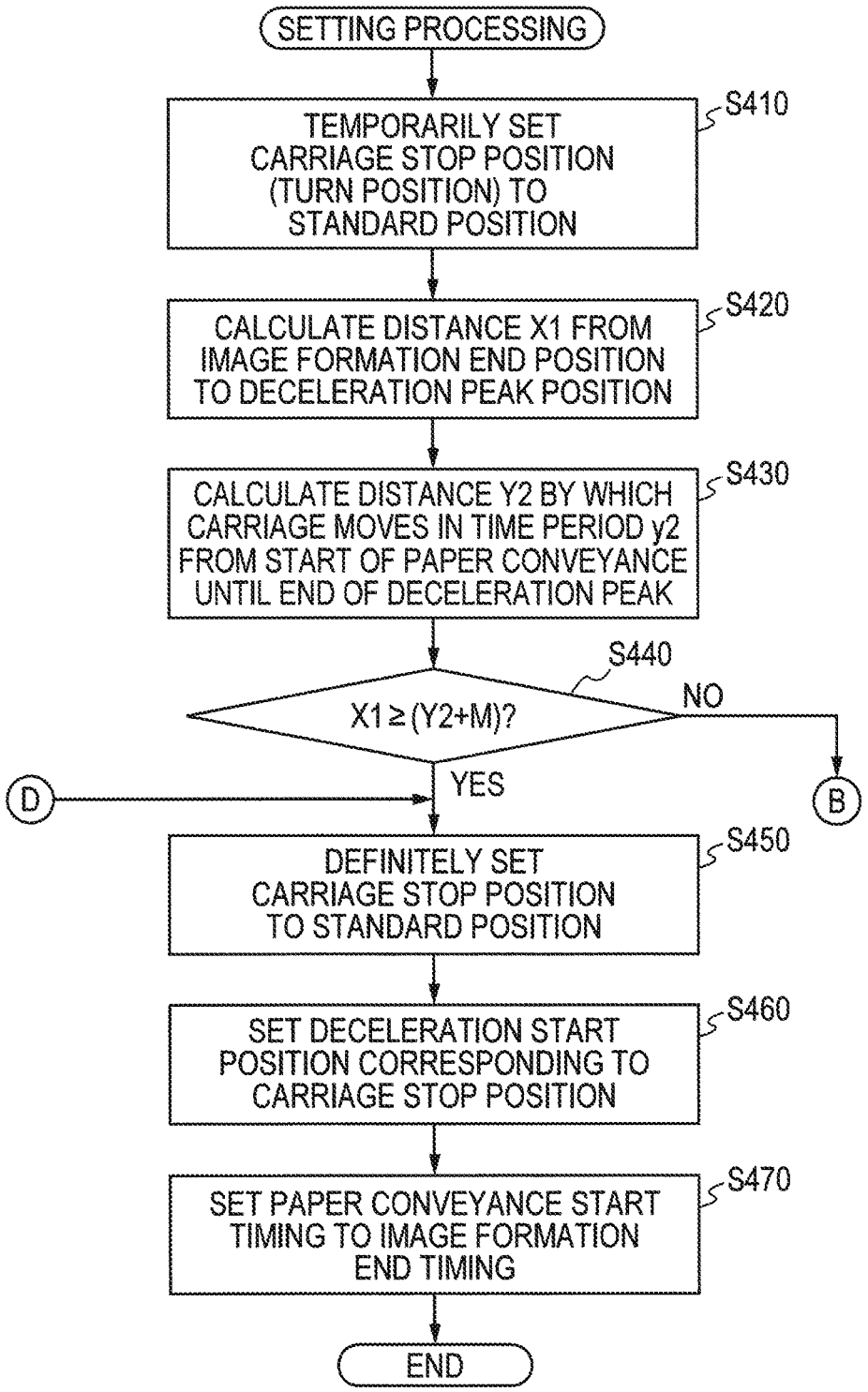
FIG. 9 is a flowchart showing setting processing (a first part) that is executed by the main controller according to a second embodiment.

Upon starting setting processing shown in FIG. 9 in S140 (FIG. 3), in a similar manner to the processing in S210, the main controller 10 temporarily sets the carriage stop position to the standard position (S410). After that, the main controller 10 calculates a distance X1 from an image formation end position of the current pass to a deceleration peak position in a case where the carriage stop position is the standard position (S420).

The deceleration peak position is a position in the main scanning direction at which the driving current of the CR motor 71 becomes the largest when the carriage 61 starts deceleration from the deceleration start position. The driving current corresponds to acceleration of the CR motor 71, and hence the position and time at which the driving current becomes the largest can be determined from the target profile used for conveyance control of the carriage 61.

As in the first embodiment, the deceleration start position is a position away back from the carriage stop position by the reference distance L to the upstream side in the conveyance direction. A time period x1 shown in FIGS. 12A-12C and 13A is a time period corresponding to the distance X1. That is, the time period x1 corresponds to a time period from timing when an image formation operation (that is, ink ejection operation) ends to timing when the driving current of the CR motor 71 becomes the largest due to deceleration of the carriage 61.

White circles in FIGS. 12A-12C and 13A-13B indicate peaks of driving currents. As in FIGS. 8A-8C, in FIGS. 12A-12C and 13A-13B, the CR velocity waveforms are shown by the solid lines, and the PF velocity waveforms are shown by the single-dot chain lines. As in FIGS. 8A-8C, it should be understood that the CR velocity waveforms and the PF velocity waveforms shown here schematically show acceleration and deceleration, and do not accurately show actual velocity waveforms. Likewise, the peaks indicated by the white circles are drawn for describing technique of this disclosure, and do not accurately show actual current peaks.

Figure 12A:
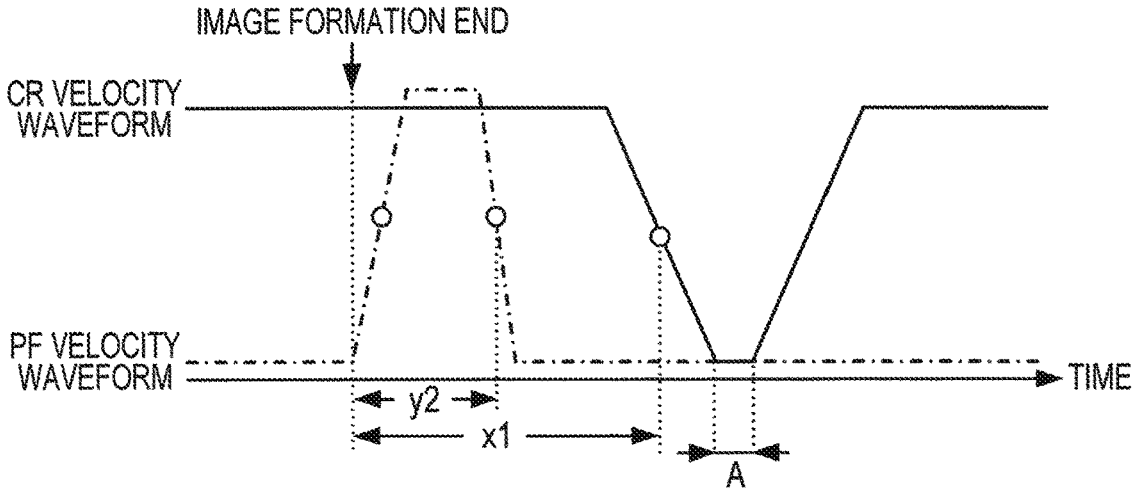
FIGS. 12A to 12C are explanatory diagrams for showing examples of deceleration of the carriage and conveyance of paper in the second embodiment.
Figure 12B:
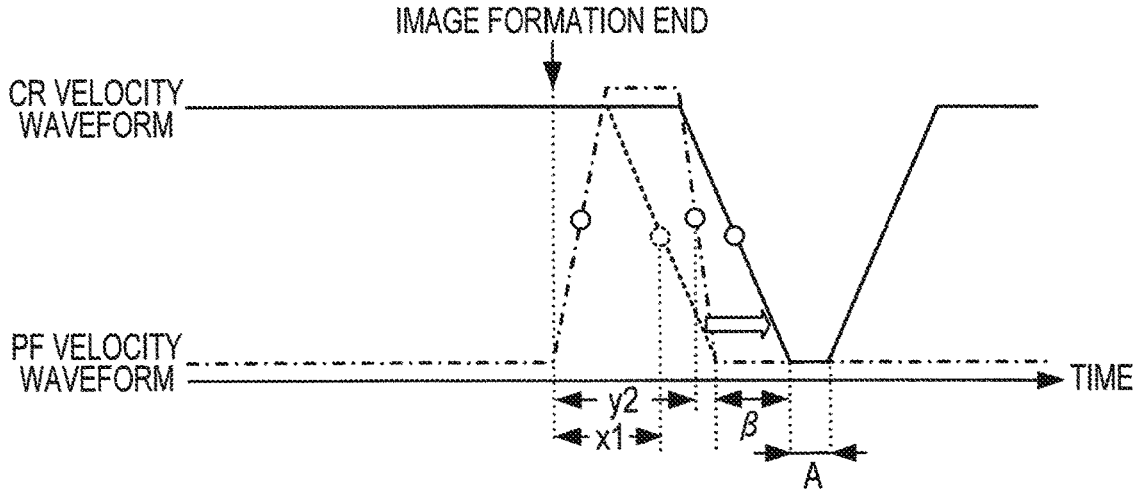

After the processing of S420, the main controller 10 further calculates a distance Y2 in which the carriage 61 moves in a constant velocity state in a time period y2 from timing when the PF motor 91 starts driving for conveying paper Q by the particular amount until timing when the deceleration peak of the driving current of the PF motor 91 ends (S430). The time period y2 is also shown in FIGS. 12A and 12B.

The driving current of the PF motor 91 has two peaks in a period in which paper Q is conveyed by the particular amount. The first peak occurs when paper Q accelerates after start of conveyance. The second peak occurs when paper Q decelerates before end of conveyance. In the following description, the first peak is referred to as "acceleration peak", and the second peak is referred to as "deceleration peak".

When the moving velocity of the carriage 61 in the constant velocity state is V, the distance Y2 can be calculated from the expression $Y2=V \cdot y2$. The time period y2 can be theoretically calculated from the operation of the PF motor 91 when paper Q is conveyed by the particular amount in accordance with the target profile.

In S440, the main controller 10 determines whether the distance X1 is larger than or equal to a distance (Y2+M) that is obtained by adding a margin amount M to the distance Y2. In response to determining that the distance X1 is larger than or equal to the distance (Y2+M) (S440: Yes), the main controller 10 moves to the processing of S450. In response to determining that the distance X1 is smaller than the distance (Y2+M) (S440: No), the main controller 10 moves to the processing of S480 (see FIG. 10).

As shown in FIG. 12A, in a case where the distance X1 is larger than the distance (Y2+M), even if conveyance of paper Q is started at the end timing of the image formation operation, the deceleration peak of the CR motor 71 does not come by the time the acceleration peak and the deceleration peak of the PF motor 91 end. The deceleration peak of the CR motor 71 comes at a point away from the deceleration peak of the driving current of the PF motor 91 by at least the margin amount M.

In this way, in the case of the distance X1≥the distance (Y2+M), even if the basic operation is performed as in the first embodiment, the peak period of the driving current of the CR motor 71 and the peak period of the driving current of the PF motor 91 do not overlap. Hence, in S450, the main controller 10 definitely sets the carriage stop position to the standard position (S450), and sets the deceleration start position to the position away from the carriage stop position by the reference distance L to the upstream side (S460).

Further, the main controller 10 sets the conveyance start timing of paper Q to the end timing of the image formation operation of the carriage 61 (S470). After that, the main controller 10 ends the setting processing shown in FIG. 9. In the processing of S150-S180 after the carriage stop position, the deceleration start position, and the paper conveyance start timing are set in this way, as shown in FIG. 12A, conveyance control of the carriage 61 and paper Q is performed in a similar manner to the case where a positive determination is made in S240 in the first embodiment.

In the present embodiment, however, unlike the first embodiment, in a case where, in S150, the conveyance operation of paper Q started in the immediately preceding processing of S180 has not ended, the main controller 10 controls the carriage conveyance mechanism 60 to start conveyance of the carriage 61 at particular timing before the end of the conveyance operation of paper Q corresponding to end timing of the conveyance operation of paper Q. Specifically, the main controller 10 controls the carriage conveyance mechanism 60 to start conveyance of the carriage 61 at the end timing of the deceleration peak of the PF motor 91 before the end of the conveyance operation of paper Q.

On the other hand, upon moving to S480 (see FIG. 10) because the distance X1 is smaller than the distance (Y2+M), the main controller 10 calculates a value β=Y2−X1+M. The value β corresponds to the difference between the distance (Y2+M) and the distance X1, and is a substitute for the difference α in the first embodiment. The value β is used for determining whether it is appropriate to shift the carriage stop position from the standard position to the downstream side in the conveyance direction of the carriage 61 by the value β, thereby shifting the deceleration start position to the downstream side by the value β.

In S490, the main controller 10 determines whether the value β calculated in S480 is smaller than or equal to an upper limit βmax. The upper limit βmax is defined by the expression below.

$$\beta\max=(B2-A)\cdot V/2 \quad (4)$$

The upper limit βmax corresponds to the largest value of the value β satisfying a relationship that a third time period T3 is smaller than or equal to a fourth time period T4. The third time period T3 and the fourth time period T4 are expressed as below.

$$T3=\beta/V+D+A+D+\beta/V \quad (5)$$

$$T4=D+B2+D \quad (6)$$

The values D, A, V in the expression (5) and the expression (6) are the same as those in the expressions (2) and (3). That is, the third time period T3 corresponds to a time period that is required, when the deceleration start position and the carriage stop position are shifted by the value β (that is, the position shift is performed), from timing when the carriage 61 passes the image formation end position until timing when the carriage 61 reaches the image formation start position of the next pass so as to start an image formation operation.

Figure 12C:
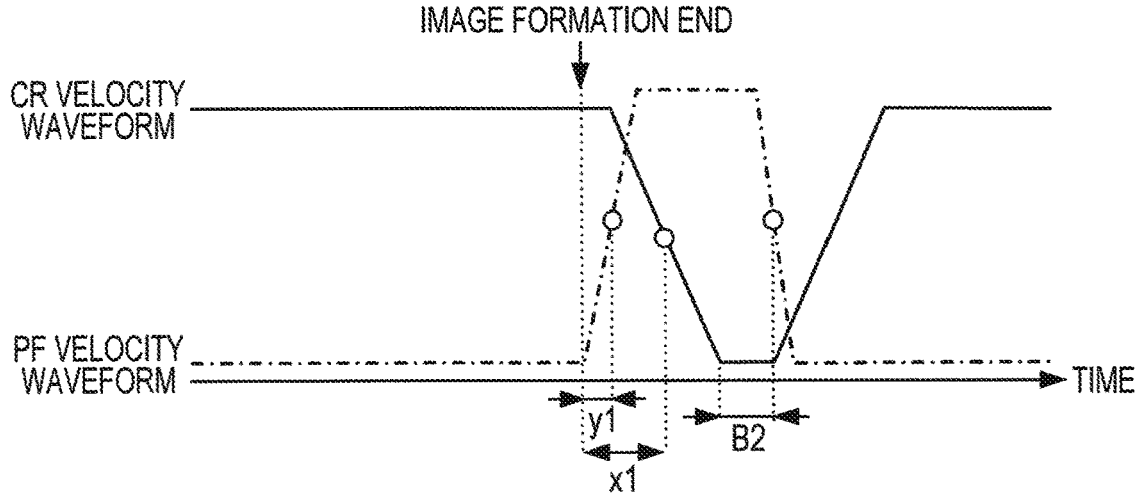

As shown in FIG. 12C, the fourth time period T4 corresponds to a time period that is required, when the PF motor 91 is driven from immediately after the end of the image formation operation before passing the deceleration peak of the CR motor 71 and drive of the CR motor 71 after turning is started after the deceleration peak of the PF motor 91 ends without performing a position shift, from timing when the carriage 61 passes the image formation end position until timing when the carriage 61 reaches the image formation start position of the next pass so as to start an image formation operation. The value B2 in the expression (6) corresponds to a stop time of the carriage 61 (the CR motor 71) at the time of turning when the CR motor 71 is controlled in the above-described manner.

That is, in S490, by determining whether the value β is smaller than or equal to the upper limit βmax, it is determined whether a print time before completion of an image formation operation on paper Q is shorter (more specifically, the carriage 61 reaches the image formation start position of the next pass at earlier timing in the conveyance process of the carriage 61 from the image formation end position of the current pass) when the position shift is performed, or the print time is shorter when the basic operation is performed without performing the position shift even if a waiting time (B2−A) occurs before start of driving the CR motor 71 after turning. More simply, it is determined which of the conveyance control based on the setting in S510-S530 and the conveyance control based on the setting in S450-S470 is more preferable in the viewpoint of the print time (throughput of printing).

In response to determining that the value β is smaller than or equal to the upper limit βmax (S490: Yes), the main controller 10 determines whether, in a case where the carriage stop position is shifted by the value β from the standard position to the downstream side in the conveyance direction of the carriage 61, the carriage stop position is within the movable range of the carriage 61 (S500).

In response to determining that the carriage 61 is within the movable range (S500: Yes), the main controller 10 definitely sets the carriage stop position to the position shifted by the value β from the standard position to the downstream side in the conveyance direction of the carriage 61 (S510), and sets the deceleration start position corresponding to the carriage stop position as in S460 (S520). Further, the main controller 10 sets the paper conveyance start timing to the end timing of the image formation operation of the carriage 61 (S530). After that, the setting processing ends.

In the processing of S150-S180 after the carriage stop position, the deceleration start position, and the paper conveyance start timing are set in this way, as shown in FIG. 12B, the conveyance operation of the particular amount of paper Q is performed at timing when the carriage 61 passes the image formation end position, deceleration of the carriage 61 is started at timing when the carriage 61 passes the deceleration start position changed by the above-described position shift, and the carriage 61 is stopped at a position away from the standard position to the downstream side by the value β. And, after a requisite minimum time A required for turning elapses, the carriage 61 returns from the stop position and is conveyed in the opposite direction from the direction before that along the main scanning direction.

The slanted line shown by the dashed line in FIG. 12B schematically shows a velocity locus during deceleration of the carriage 61 in a case where no position shift is performed. In this operation, due to the position shift of the value β, the deceleration peak of the CR motor 71 comes after the acceleration peak and the deceleration peak of the PF motor 91.

Further, in response to determining that the value β is larger than the upper limit βmax (S490: No), the main controller 10 moves to S550 (see FIG. 11). In response to determining that the carriage stop position after the position shift is not within the movable range of the carriage 61 (S500: No), the main controller 10 moves to S630.

Figure 13A:
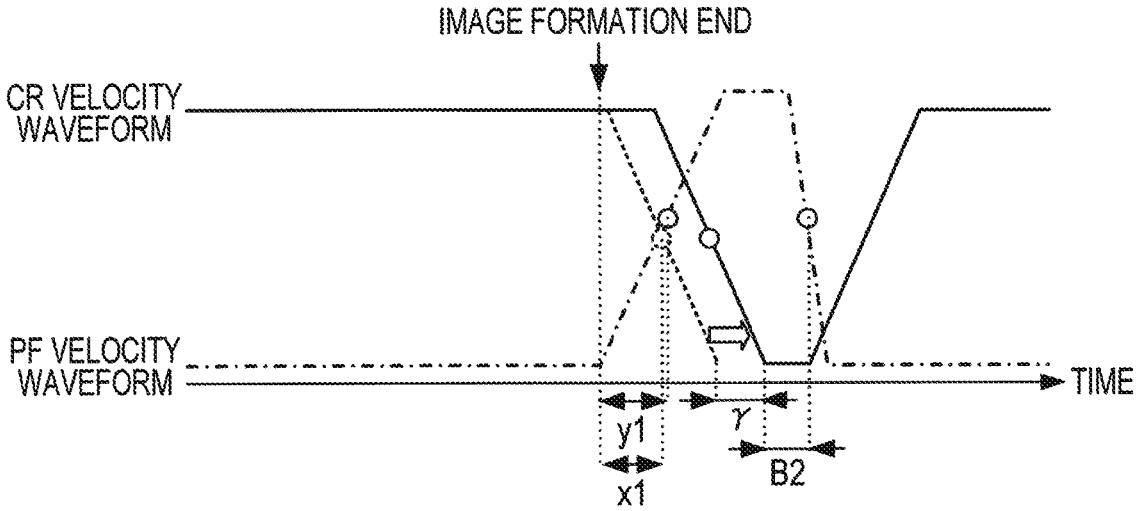
FIGS. 13A and 13B are explanatory diagrams for showing examples of deceleration of the carriage and conveyance of paper in the second embodiment.

In S550, the main controller 10 calculates a distance Y1 in which the carriage 61 in a constant velocity state moves in a time period y1 from the start of driving of the PF motor 91 for conveying paper Q by the particular amount until the end of acceleration peak of the driving current of the PF motor 91. The time period y1 is also shown in FIGS. 12C and 13A.

When the moving velocity of the carriage 61 in the constant velocity state is V, the distance Y1 can be calculated from the expression Y1=V·y1. The time period y1 can be also theoretically calculated from the operation of the PF motor 91 when paper Q is conveyed by the particular amount in accordance with the target profile.

In S560, the main controller 10 determines whether the distance X1 is larger than or equal to a distance (Y1+M) that is obtained by adding a margin amount M to the distance Y1. In response to determining that the distance X1 is larger than or equal to the distance (Y1+M) (S560: Yes), the main controller 10 moves to S450 (see FIG. 9). In response to determining that the distance X1 is smaller than the distance (Y1+M) (S560: No), the main controller 10 moves to S570.

In a case where the setting in S450-S470 is performed because the distance X1 is larger than or equal to the distance (Y1+M), in the processing of S150-S180 after that, the conveyance operation of the carriage 61 and paper Q is performed as shown in FIG. 12C. In this case, after the carriage 61 is stopped at the standard position, at the end timing of the deceleration peak in conveyance operation of paper Q, the carriage 61 returns from the standard position and is conveyed in the opposite direction from the direction before that along the main scanning direction.

Upon moving to S570 because the distance X1 is smaller than the distance (Y1+M), the main controller 10 calculates a value γ=Y1−X1+M. The value γ corresponds to the difference between the distance (Y1+M) and the distance X1. Like the value β, the value γ is used for determining whether a position shift is appropriate.

In S580, the main controller 10 determines whether the value γ is smaller than or equal to an upper limit γmax. The upper limit γmax is defined by the expression below.

$$\gamma max=(B1-B2)\cdot V/2 \tag{7}$$

Specifically, the upper limit γmax corresponds to the largest value of the value γ satisfying a relationship that a fifth time period T5 is smaller than or equal to a sixth time period T6. Here, the fifth time period T5 and the sixth time period T6 are expressed as below.

$$T5=\gamma/V+D+B2+D+\gamma/V \tag{8}$$

$$T6=D+B1+D \tag{9}$$

The values D, B2, V in the expressions (7) to (9) are the same as those in the expressions (4) to (6). That is, as shown in FIG. 13A, the fifth time period T5 corresponds to a time period required, in a case where the deceleration start position and the carriage stop position are shifted by the value γ, from timing when the carriage 61 passes the image formation end position until timing when the carriage 61 reaches the image formation start position of the next pass so as to start an image formation operation.

Figure 13B:
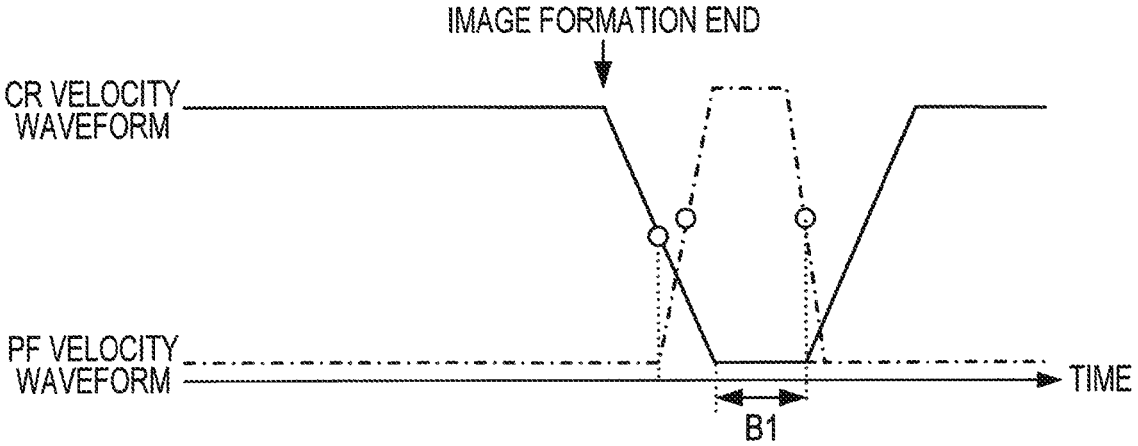

As shown in FIG. 13B, the sixth time period T6 corresponds to a time period required from timing when the carriage 61 passes the image formation end position until timing when the carriage 61 reaches the image formation start position of the next pass so as to start an image formation operation in a case where, without performing a position shift, drive of the PF motor 91 is deferred until the end of the deceleration peak of the CR motor 71 and the PF motor 91 is driven to start paper conveyance after the deceleration peak of the CR motor 71 ends. The value B1 in the expressions (7) and (9) corresponds to a stop time of the carriage 61 (the CR motor 71) at the time of turning in a case where the CR motor 71 is controlled in the above-described manner.

That is, in S580, by determining whether the value γ is smaller than or equal to the upper limit γmax, it is determined which of the conveyance control based on setting in S600-S620 and the conveyance control based on setting in S630-S650 is more preferable in the viewpoint of the print time (throughput of printing).

In response to determining that the value γ is smaller than or equal to the upper limit γmax (S580: Yes), the main controller 10 moves to the processing of S590. In response to determining that the value γ is larger than the upper limit γmax (S580: No), the main controller 10 moves to the processing of S630.

In S590, the main controller 10 determines whether, in a case where the carriage stop position is shifted by the value γ from the standard position to the downstream side in the conveyance direction of the carriage 61, the carriage stop position is within the movable range of the carriage 61.

In response to determining that the carriage 61 is within the movable range (S590: Yes), the main controller 10 moves to the processing of S600. In response to determining that the carriage 61 is not within the movable range (S590: No), the main controller 10 moves to the processing of S630.

In S600, the main controller 10 definitely sets the carriage stop position to the position shifted by the value γ from the standard position to the downstream side in the conveyance direction of the carriage 61. The main controller 10 further sets the deceleration start position corresponding to the carriage stop position (S610). Further, the main controller 10 sets the paper conveyance start timing to the end timing of the image formation operation of the carriage 61 (S620). After that, the setting processing ends.

In the processing of S150-S180 after the carriage stop position, the deceleration start position, and the paper conveyance start timing are set in this way, the conveyance operation of the carriage 61 and paper Q is performed as shown in FIG. 13A. In this operation, due to the position shift of the value γ, the deceleration peak of the CR motor 71 comes between the acceleration peak and the deceleration peak of the PF motor 91.

On the other hand, upon moving to S630, the main controller 10 definitely sets the carriage stop position to the standard position, and sets the deceleration start position corresponding to this carriage stop position (S640). The main controller 10 further sets the paper conveyance start timing to the end timing of the deceleration peak of the CR motor 71 (S650), and ends the setting processing.

In the processing of S150-S180 after the carriage stop position, the deceleration start position, and the paper conveyance start timing are set in this way, as shown in FIG. 13B, the carriage 61 passes the deceleration start position without performing the conveyance operation of paper Q even after the carriage 61 passes the image formation end position, the carriage 61 starts deceleration and, at timing when the deceleration peak of the CR motor 71 ends, a conveyance operation of paper Q by the particular amount is performed. After that, at timing when the deceleration peak of the PF motor 91 ends in the conveyance operation of paper Q, the carriage 61 returns from the standard position and is conveyed in the opposite direction from the direction before that along the main scanning direction.

According to the image forming system 1 in the present embodiment described above, the CR motor 71 and the PF motor 91 are driven such that the deceleration peak period of carriage conveyance does not overlap the acceleration peak period or the deceleration peak period of paper conveyance. Thus, the CR motor 71 and the PF motor 91 can be driven in a partially overlapping manner by using the common power supply 99 of a small type having a small suppliable current. That is, while avoiding the driving currents of the CR motor 71 and the PF motor 91 exceed the upper limit of the suppliable current of the common power supply 99, the CR motor 71 and the PF motor 91 can be driven concurrently.

According to the present embodiment, from among a plurality of methods in which the deceleration peak period of the carriage conveyance does not overlap the acceleration peak period or the deceleration peak period of paper conveyance, a method having a short print time, that is, a good throughput of printing is selected and performed. Thus, while using the common power supply 99 of a small type and reducing manufacturing costs, the image forming system 1 having good throughput can be formed.

While the disclosure has been described in detail with reference to the above aspects thereof, it would be apparent to those skilled in the art that various changes and modifications may be made therein without departing from the scope of the claims.

For example, in the first embodiment, carriage conveyance after turning is performed after paper conveyance ends. However, as in the second embodiment, the carriage conveyance may be started before the end of paper conveyance at such timing that the deceleration peak of the PF motor 91 and the acceleration peak of the CR motor 71 do not overlap. That is, the carriage conveyance after turning may be performed before stop of conveyance of paper Q, at the time of stop of conveyance of paper Q, or after stop of conveyance of paper Q.

A function of one element in the above-described embodiments may be distributedly provided in a plurality of elements. Functions of a plurality of elements may be integrated into one element. A part of the configuration in the above-described embodiments may be omitted. At least part of the configuration in one embodiment may be added to configurations in another embodiment, or may be replaced by a configuration in another embodiment.

The recording head 50 is a non-limiting example of an ejector. The CR motor 71 and the carriage conveyance mechanism 60 are a non-limiting example of a first conveyor. The PF motor 91 and the paper conveyance mechanism 80 are a non-limiting example of a second conveyor. The main controller 10, the print controller 30, and the conveyance controller 40 are a non-limiting example of a controller.

What is claimed is:

1. An image forming system comprising:

an ejector configured to eject ink toward a sheet;

a first conveyor configured to cause the ejector to reciprocate along a main scanning direction;

a second conveyor configured to convey the sheet in a sub-scanning direction;

a common power supply configured to supply electric power to the first conveyor and the second conveyor; and a controller configured to repeatedly perform controlling the second conveyor to convey the sheet by a particular amount in the sub-scanning direction, controlling the first conveyor to convey the ejector to a turn position along the main scanning direction, and controlling the ejector in a conveyance process to eject ink toward the sheet in a stopped state, thereby forming an image on the sheet, the controller being configured to, after the ejector passes an ejection end position, control the second conveyor to convey the sheet by the particular amount in the sub-scanning direction, the ejection end position being a position of the ejector in the main scanning direction and a position at which ink ejection by the ejector ends before reaching the turn position, an ejection start position being a position of the ejector in the main scanning direction and a position at which ink ejection by the ejector starts after turning at the turn position, the controller being further configured to, based on a positional relationship between the ejection end position and a standard position, adjust timing of conveyance of the sheet or shift the turn position from the standard position in a direction of reducing an overlap between a sheet conveyance period after the ejector passes the ejection end position and an ejector deceleration period before the ejector reaches the turn position, the standard position being a standard turn position of the ejector and being determined from the ejection end position and the ejection start position.

2. The image forming system according to claim 1, wherein the controller is configured to adjust the timing of conveyance of the sheet or shift the turn position such that the sheet conveyance period and the ejector deceleration period do not overlap each other.

3. The image forming system according to claim 1, wherein the standard position is set to a position that is located at a farther downstream side in a conveyance direction of the ejector among a position away from the ejection end position by a reference distance in the conveyance direction and a position away from the ejection start position by the reference distance in a same direction as the conveyance direction.

4. The image forming system according to claim 1, wherein the controller is configured to:

determine whether a shifted position is within a movable range of the ejector, the shifted position being a position that is shifted from the standard position to a downstream side in a conveyance direction of the ejector by a distance necessary for reducing the overlap;

in response to determining that the shifted position is within the movable range of the ejector, shift the turn position from the standard position to the shifted position; and in response to determining that the shifted position is not within the movable range of the ejector, adjust the timing of conveyance of the sheet.

5. The image forming system according to claim 1, wherein the controller is configured to adjust the timing of conveyance of the sheet or shift the turn position such that a peak of driving current of the second conveyor in the sheet conveyance period and a peak of driving current of the first conveyor in the ejector deceleration period do not overlap each other.

6. The image forming system according to claim 5, wherein the controller is configured to:

in a first case where it is assumed that, when conveyance of the sheet is started at timing when the ejector passes the ejection end position, a peak of a driving current of the second conveyor ends before a driving current of the first conveyor reaches a peak due to deceleration of the ejector, start conveyance of the sheet at timing when the ejector passes the ejection end position; and in a second case where it is assumed that, when conveyance of the sheet is started at timing when the ejector passes the ejection end position, the peak of the driving current of the second conveyor does not end before the driving current of the first conveyor reaches the peak, adjust timing of conveyance of the sheet or shift the turn position from the standard position in a direction of reducing an overlap between the peak of the driving current of the first conveyor and the peak of the driving current of the second conveyor.

7. The image forming system according to claim 6, wherein the controller is configured to, in the second case, in order to reduce the overlap, perform one of:

first processing of performing conveyance of the sheet after waiting until the peak of the driving current of the first conveyor ends in a deceleration process of the ejector; and second processing of shifting the deceleration start position and the turn position so as to move the turn position from the standard position to a downstream side in a moving direction of the ejector and starting conveyance of the sheet at timing when the ejector passes the ejection end position.

8. The image forming system according to claim 7, wherein the controller is configured to, in the second case, selectively perform, among the first processing and the second processing, processing in which the ejector reaches the ejection start position at earlier timing in a conveyance process of the ejector from the ejection end position.

9. The image forming system according to claim 7, wherein the shifting the deceleration start position and the turn position comprises:

moving the deceleration start position and the turn position to the downstream side such that, when conveyance of the sheet is started at timing when the ejector passes the ejection end position, the peak of driving current of the second conveyor ends before the driving current of the first conveyor reaches the peak due to deceleration of the ejector.

10. The image forming system according to claim 7, wherein the peak of the driving current of the second conveyor includes a first peak that occurs during acceleration of the sheet and a second peak that occurs during deceleration of the sheet; and wherein the shifting the deceleration start position and the turn position comprises:

moving the deceleration start position and the turn position to the downstream side such that, when conveyance of the sheet is started at timing when the ejector passes the ejection end position, the second peak of the driving current of the second conveyor ends before the driving current of the first conveyor reaches the peak due to deceleration of the ejector, or the peak of the driving current of the first conveyor occurs between the first peak and the second peak of the driving current of the second conveyor.

11. The image forming system according to claim 1, wherein the controller is configured to:

in a first case where it is assumed that, when conveyance of the sheet is started at timing when the ejector passes the ejection end position, conveyance of the sheet is finished before the ejector reaches a deceleration start position corresponding to the standard position, start conveyance of the sheet at timing when the ejector passes the ejection end position; and in a second case where it is assumed that, when conveyance of the sheet is started at timing when the ejector passes the ejection end position, conveyance of the sheet is finished after the ejector reaches the deceleration start position, adjust the timing of conveyance of the sheet or shift the turn position in a direction of reducing the overlap.

12. The image forming system according to claim 11, wherein the controller is configured to, in the second case, in order to reduce the overlap, perform one of:

first processing of performing conveyance of the sheet after waiting until the ejector ends deceleration and stops at the standard position; and second processing of shifting the deceleration start position and the turn position so as to move the turn position from the standard position to a downstream side in a moving direction of the ejector and starting conveyance of the sheet at timing when the ejector passes the ejection end position.

13. The image forming system according to claim 12, wherein the controller is configured to, in the second case, selectively perform, among the first processing and the second processing, processing in which the ejector reaches the ejection start position at earlier timing in a conveyance process of the ejector from the ejection end position.

14. The image forming system according to claim 12, wherein the shifting the deceleration start position and the turn position comprises:

moving the deceleration start position and the turn position to the downstream side such that, when conveyance of the sheet is started at timing when the ejector passes the ejection end position, conveyance of the sheet is finished before the ejector reaches the deceleration start position.

* * * * *